US011927429B2

(12) United States Patent
Bouvet et al.

(10) Patent No.: US 11,927,429 B2
(45) Date of Patent: Mar. 12, 2024

(54) DECISION ASSISTANCE SYSTEM AND METHOD FOR FIRING A PROJECTILE AT A TARGET

(71) Applicant: SAFRAN ELECTRONICS & DEFENSE, Paris (FR)

(72) Inventors: Alexandre Bouvet, Moissy-Cramayel (FR); Laurent Goumy, Moissy-Cramayel (FR); Yoann Chevalier, Moissy-Cramayel (FR)

(73) Assignee: SAFRAN ELECTRONICS & DEFENSE, Paris (FR)

( * ) Notice: Subject to any disclaimer, the term of this patent is extended or adjusted under 35 U.S.C. 154(b) by 118 days.

(21) Appl. No.: 17/629,068

(22) PCT Filed: Jul. 22, 2020

(86) PCT No.: PCT/FR2020/051341

§ 371 (c)(1),
(2) Date: Jan. 21, 2022

(87) PCT Pub. No.: WO2021/014101

PCT Pub. Date: Jan. 28, 2021

(65) Prior Publication Data

US 2022/0276023 A1 Sep. 1, 2022

(30) Foreign Application Priority Data

Jul. 22, 2019 (FR) ..... 1908231

(51) Int. Cl.
*F41G 9/02* (2006.01)

(52) U.S. Cl.
CPC ..... *F41G 9/02* (2013.01)

(58) Field of Classification Search
CPC ..... F41G 9/02; F41G 7/007; F41G 7/2233; F41G 7/006
See application file for complete search history.

(56) References Cited

U.S. PATENT DOCUMENTS

2008/0206718 A1* 8/2008 Jaklitsch ..... F41A 31/00 434/12
2015/0059564 A1* 3/2015 De Sa ..... F41H 13/00 89/1.11

FOREIGN PATENT DOCUMENTS

FR 3 099 241 B1 7/2021

OTHER PUBLICATIONS

French Search Report for French Application No. 1908231, daled May 15, 2020.

(Continued)

*Primary Examiner* — Sonji N Johnson
(74) *Attorney, Agent, or Firm* — Birch, Stewart, Kolasch & Birch, LLP

(57) ABSTRACT

A system for firing a projectile mounted on a carrier, the decision assistance system comprising: a first simulator for simulating a navigation system of the carrier and configured to produce a precision of a solution for navigation of the carrier; a second simulator for simulating a navigation system of the projectile and configured to be initialized with the precision of the solution for navigation of the carrier and produce a precision of a solution for navigation of the projectile; and a selector configured to select or not the projectile as projectile to be fired as a function of the precision of a solution for navigation of the projectile.

14 Claims, 2 Drawing Sheets

(56) References Cited

OTHER PUBLICATIONS

Guo et al., "Weapon-Target Assignment for Multi-to-Multi Interception With Grouping Constraint", IEEE Access, vol. 7, Feb. 12, 2019 (date of current version Apr. 1, 2019), pp. 34838-34849.
International Search Report and Written Opinion for international Application No. PCT/FR2020/051341, dated Nov. 2, 2020.

* cited by examiner

DECISION ASSISTANCE SYSTEM AND METHOD FOR FIRING A PROJECTILE AT A TARGET

FIELD OF THE INVENTION

The present invention relates to a system and a decision assistance process for firing at least one projectile mounted on a mobile carrier at a target.

PRIOR ART

It is known to load several projectiles to be fired at a target onto a mobile carrier, such as an aircraft.

But the various projectiles available cannot exhibit the same performance in terms of aiming precision, above all if the projectiles are different types. These performances depend on the projectiles themselves, but also on their environment (for example, jammers can impede their operation).

PRESENTATION OF THE INVENTION

An aim of the invention is to help select in advance a high-performance projectile to fire at a target.

To that end and according to a first aspect, a firing decision assistance system at a target of a projectile mounted on a mobile carrier is proposed, the system comprising:

- a first simulator for simulating a navigation system of the carrier, the first simulator being configured to apply a first processing repeatedly to a first set of simulated data representative of a configuration of the carrier and of a trajectory of the carrier between a first instant and a second instant, so as to produce prior to the second instant a precision of a solution for navigation of the carrier associated with the second instant,
- a second simulator for simulating a navigation system of the projectile, the second simulator being configured to:
  - a) be initialized with the precision of the solution for navigation of the carrier associated with the second instant,
  - b) after step a) apply a second processing repeatedly to a second set of simulated data representative of a trajectory of the projectile between the second instant and a third instant, so as to produce prior to the third instant a precision of a solution for navigation of the projectile associated with the third instant,
- a selector configured to select or not the projectile as projectile to be fired at the target, as a function of the precision associated with the third instant set out in step b).

The system according to the first aspect can comprise the following optional characteristics, taken singly or combined together when this is technically possible.

Preferably, the second simulator is also configured to:

- c) repeat step b) for at least one other projectile mounted on the mobile carrier, and the selector is configured to select a projectile to be fired at the target from the projectiles mounted on the mobile carrier, as a function of the precisions associated with the third instant set out in steps b) and c).

Preferably, the system comprises a navigation system for the carrier, configured to apply the first processing to data acquired by sensors to produce a solution for navigation of the carrier associated with the first instant and a precision of the solution for navigation of the carrier associated with the first instant, wherein the first simulator is configured to be initialized at the first instant with the solution for navigation associated with the first instant and with the precision of the solution for navigation of the carrier associated with the first instant.

Preferably, at least one of the first processing and the second processing comprises hybridization capable of being implemented between data originating from sensors of different types, for example inertial data and satellite—positioning data.

Preferably, the second instant is a predetermined instant when the projectile is to separate from the carrier.

Preferably, at least one of the first set of simulated data and the second set of simulated data comprises at least one of the following data:

- movement data of the carrier and/or of the projectile,
- data characteristic of a receiving device of radiofrequency signals,
- data characteristic of jamming implemented by a jammer on radiofrequency signals,
- mission parameters, comprising for example an instant when the projectile is powered up, an instant when the projectile is separated from the carrier, an orientation to be adopted by the projectile at the third instant,
- relative positioning data between the carrier and the projectile between the first instant and the second instant,
- atmospheric condition data between the first instant and the third instant,
- topographical data of a zone intended to be traversed by the carrier between the first instant and the third instant.

According to a second aspect a carrier is also proposed, for example an aircraft, comprising at least one projectile and a system according to the first aspect for decision assistance for firing a projectile at a target.

According to a third aspect, a decision assistance method is also proposed for firing a projectile mounted on a mobile carrier at a target, the method being performed by a firing decision assistance system comprising a first simulator for simulating a navigation system of the carrier and a second simulator for simulating projectile navigation systems, the method comprising steps of:

- a) application by the first simulator of a first processing repeatedly to a first set of simulated data representative of a configuration of the carrier and of a trajectory of the carrier between a first instant and a second instant, so as to produce prior to the second instant a precision of a solution for navigation of the carrier associated with the second instant,
- b) initialization of the second simulator with the precision of the solution for navigation of the carrier associated with the second instant,
- c) after the initialization, application by the second simulator of a second processing repeatedly to a second set of simulated data representative of a trajectory of the projectile between the second instant and a third instant, so as to produce prior to the third instant a precision of a solution for navigation of the projectile associated with the third instant,
- e) selection or not of the projectile as projectile to be fired at the target, as a function of the precision associated with the third instant set out in step c).

Preferably, this method comprises a step d) for repetition by the second simulator of the application of the second processing for at least one other projectile mounted on the mobile carrier, a projectile to be fired at the target being selected at step e) from the projectiles mounted on the mobile carrier, as a function of the precisions associated with the third instant set out in steps c) and d).

The carrier can be an aircraft.

At least one of the projectiles can be a guided bomb, typically of AASM type.

According to a fourth aspect, a computer program product is also proposed comprising program code instructions for executing the steps of the process according to the third aspect, when this process is executed by a firing decision assistance system.

DETAILED DESCRIPTION OF AT LEAST ONE EMBODIMENT OF THE INVENTION

Figure 1:
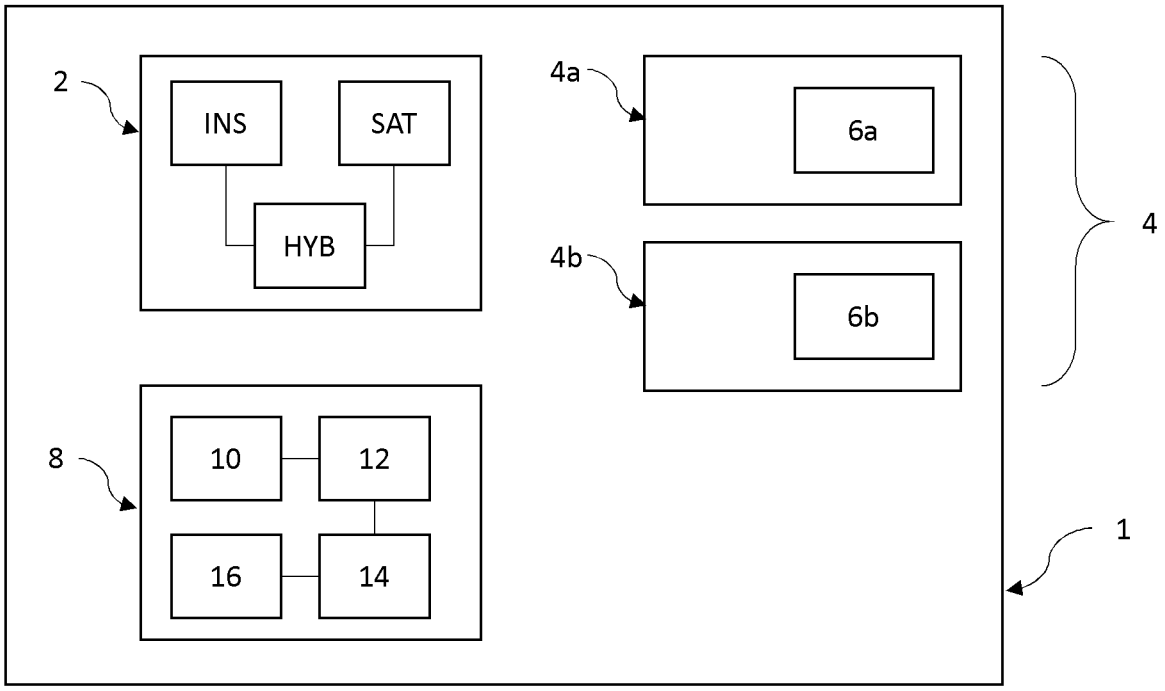
FIG. 1 schematically illustrates a mobile carrier according to an embodiment.

A mobile carrier 1 is shown schematically in FIG. 1.

The carrier 1 is typically an aircraft, for example a plane, a drone or a helicopter.

The carrier 1 comprises a navigation system 2 for producing solutions for navigation of the carrier 1 from data originating from sensors. A solution for navigation produced by the navigation system of the carrier 1 comprises for example a position, a speed and/or an attitude of the carrier 1.

The navigation system 2 is also configured to produce precisions relative to the solutions for navigation of the carrier 1. These precisions typically comprise a covariance relating to the data for speed, position or attitude of the carrier 1.

The navigation system 2 of the carrier 1 is configured to operate clocked, so each solution for navigation which it produces (and the precision relative to the solution) is associated with a given instant. In this way, the system performs the same processing repeatedly over time, at successive instants.

The navigation system 2 of the carrier 1 comprises for example an inertial unit INS, a satellite-positioning system SAT (typically of GPS/GNSS type), and a hybridization device HYB.

The inertial unit INS comprises a plurality of inertial sensors, typically accelerometers and gyrometers, providing inertial data.

The satellite—positioning system SAT for its part supplies data originating from signals sent by satellites. The satellite signals which this system SAT acquires are likely to be jammed by external jammers.

The hybridization device HYB is configured to perform hybridization of data provided by the inertial unit and the satellite—positioning system so as to produce on this basis a solution for navigation of the carrier 1. The hybridization is for example a tight coupling or a loose coupling.

The carrier 1 also comprises a plurality of projectiles 4 able to be fired at a target. The carrier shown schematically in FIG. 1 comprises two projectiles, referenced respectively 4*a* and 4*b*, but can quite obviously take on more projectiles.

The projectiles 4 can be different kinds. One of the projectiles is typically a guided bomb, for example of AASM type.

Each projectile 4 comprises an internal navigation system. The function of a projectile navigation system is to produce a solution for navigation of the projectile from data originating from a sensor. The projectile navigation system can for example comprise the same components as the navigation system of the carrier 1, and operate the same way, but this is not obligatory.

The carrier 1 also comprises a decision assistance system 8 for firing at a target.

The decision assistance system 8 comprises a first simulator 10, a second simulator 12 and a selector 14.

The function of the first simulator 10 is to simulate the operation of the navigation system 2 of the carrier 1. The processings performed by the navigation system 2 of the carrier 1 are also performed by the first simulator 10 (hybridization especially). The first simulator 10 produces at output solutions for navigation of the same type as those produced by the navigation system of the carrier 1.

The first simulator 10 inputs simulated data, representative of a configuration of the carrier 1 and of a trajectory of the carrier 1 over a time period comprising several instants, therefore covering a long time period. Such data can be determined in advance during mission planning.

Unlike the navigation system 2 of the carrier 1, which is supposed to report on the position, the speed or the attitude of the carrier 1 in real time, the first simulator 10 is scheduled to apply the same processings, but by repeating in an accelerated manner on the basis of these simulated data, so that it can predict what the position, the speed or the attitude of the carrier 1 will be at any future instant.

The first simulator 10 is for example in the form of a processor configured to execute a simulation program performing this simulation function of the navigation system of the carrier 1.

The function of the second simulator 12 per se is to simulate the operation of the navigation systems 6*a*, 6*b* of the projectiles 4. The processings performed by the respective navigation systems 6*a*, 6*b* of the projectiles 4 are also performed by the second simulator 12. The second simulator 12 produces solutions for navigation of the same type as those produced by the navigation systems of the projectiles 4.

The simulated data input by the second simulator 12 are data representative of a configuration of projectiles and of trajectories of projectiles over a time period comprising several instants, therefore covering a long time period.

Unlike the navigation systems 6*a* and 6*b* of the projectiles 4, which are supposed to report on the position, the speed or the attitude of these projectiles in real time, the second simulator 12 is scheduled to apply the same processings, but by repeating in an accelerated manner on the basis of these simulated data, so that it can predict what the position, the speed or the attitude of the projectiles 4 will be at any future instant.

The second simulator 12 is for example in the form of a processor configured to execute a simulation program performing this simulation function of projectile navigation systems.

The first simulator 10 and the second simulator 12 can for example form two simulation modules of the same program, executed by one or more processors.

The decision assistance system 8 also comprises a selection module 14 for selecting one of the projectiles mounted on the carrier 1 for firing at a target. This selection module 14, or more simply "selector", typically comprises at least one processor.

The decision assistance system 8 can also comprise a display monitor 16. The display monitor 16 is for example arranged in a cockpit of the carrier so that it can be seen by a pilot of the carrier.

Figure 2:
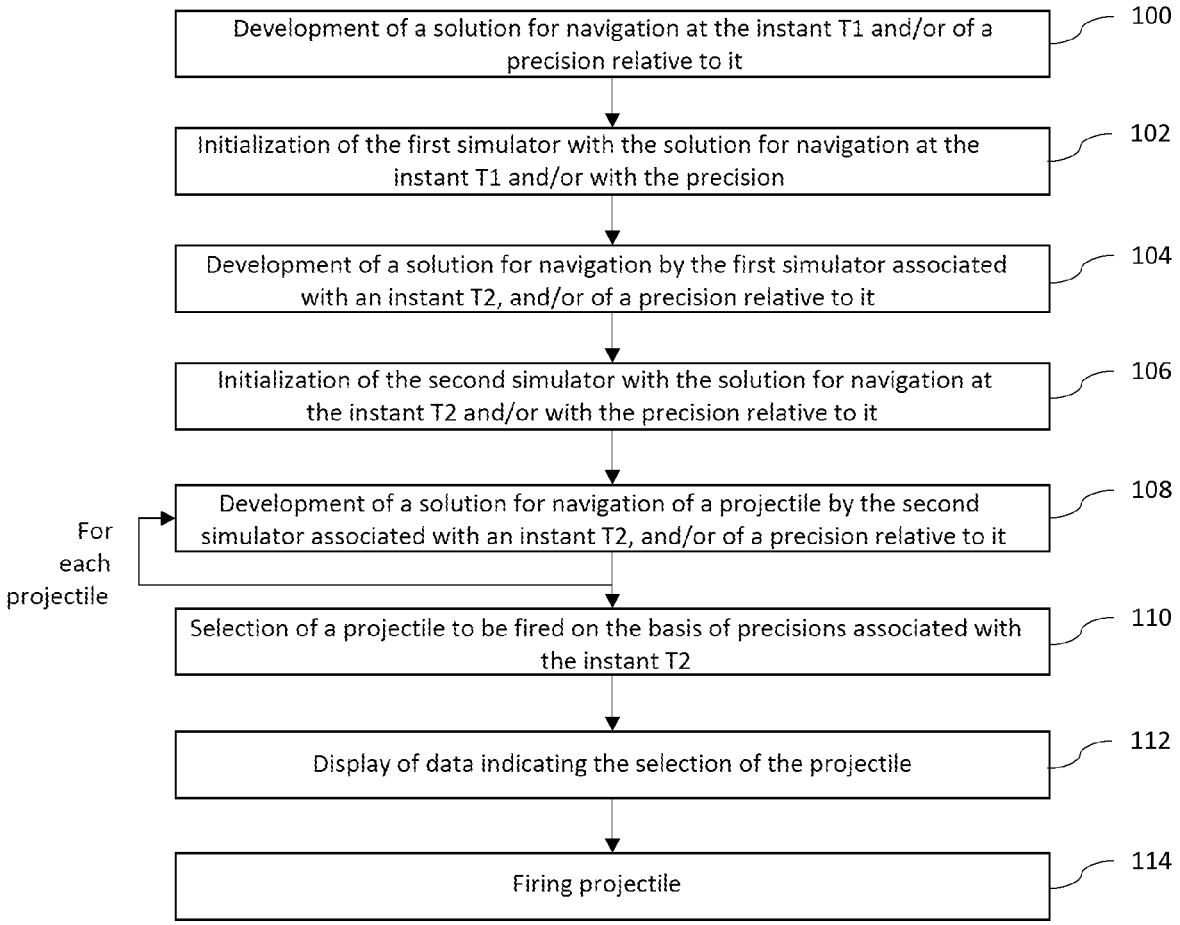
FIG. 2 is a flowchart of steps of a firing decision assistance process, according to an embodiment.

In reference to FIG. 2, a method using the decision assistance system 8 comprises the following steps.

A mission is defined in advance for the carrier 1. An objective of this mission is to fire a projectile at a target which has been previously identified.

The mission defines in advance an instant when a projectile of the carrier 1 must be fired at the target (that is, the instant when this projectile separates from the carrier 1). But the mission does not define in advance which one of the different projectiles mounted on the carrier 1 is to be fired at the target. It is precisely the objective of the decision assistance system 8 to select such a projectile.

In a preliminary step, the first simulator 10 and the second simulator 12 are parameterised to the other of at least one of the following data:

- trajectory parameters of the carrier 1 defining a trajectory of the carrier 1 (these parameters being in the form of a succession of data of attitude, position and speed of the carrier 1);
- trajectory parameters of the projectiles 4 defining a trajectory of each projectile (these parameters being in the form of a succession of data of attitude, position and speed of the projectile);
- environmental parameters defining the environment of the carrier 1 (pressure, wind, atmospheric model, temperature);
- parameters characteristic of jammers likely to disrupt the navigation systems 2, 6*a*, 6*b*, called jamming parameters hereinbelow. These parameters comprise for example, for at least one jammer, a jamming signal power sent by the jammer, a centre frequency of this signal, a bandwidth of the signal, and a position of the jammer;
- parameters called "aerial" defining reception conditions of satellite positioning signals received by the navigation systems 2, 6*a*, 6*b*. The aerial parameters comprise for example: a diagram of an antenna of the carrier 1 or of a projectile 4 used to capture these positioning signals, parameters representative of a chain RF, a type of the antenna, an ephemeris indicating the evolution of the position of a satellite constellation over time.
- scenario parameters of the carrier 1, that is, flight parameters of the carrier 1 from an initial instant to the instant of firing the projectile (speed, altitude, heading, rolling, pitching . . . );
- scenario parameters of the projectiles, that is, projectile firing parameters: distance to the target, flight time, difference in altitude on initialization of the trajectory (firing), field of the target relative to the axis of the projectile (de-aiming), etc.

The mission comprises two phases:

- a first phase during which the carrier 1 approaches the target, the first phase terminating when a projectile is fired by the carrier 1.
- a second phase starting up when firing occurs, and terminating when the fired projectile hits the target.

During the first phase, the navigation system of the carrier 1 is requested by conventional means to guide the carrier 1. In other words, during the first phase over time the navigation system 2 of the carrier 1 repeatedly produces successive solutions for navigation of the carrier 1 associated with different instants.

Figure 3:
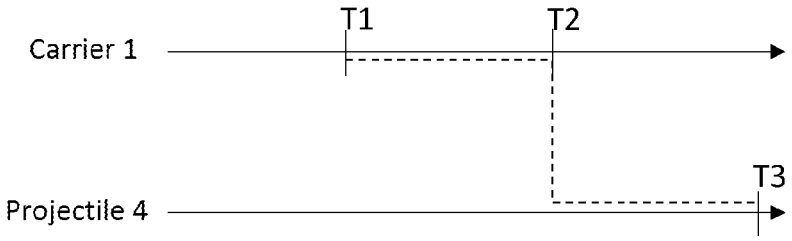
FIG. 3 shows two timelines from the viewpoint of a carrier and a projectile of this carrier, and indicates several instants of interest during the implementation of the process of FIG. 2.

There is the example of a reference instant T1 included in the first phase, known as "first instant" hereinbelow. FIG. 3 also shows a second instant T2 when a projectile 4 is scheduled to be fired, and a third instant T3 when the projectile fired is supposed to collide with the target.

The carrier 1 can be already in flight at the first instant T1. But the first instant T1 can also be a much earlier instant, for example even prior to the carrier 1 having taken off.

During the first phase, the navigation system of the carrier 1 produces a solution for navigation of the carrier 1 associated with the first instant T1, as well as a precision relative to this solution for navigation. This solution for navigation is of course produced on the basis of real data acquired by the sensors of the navigation system of the carrier 1 (inertial sensors+GNSS for example, in the event where the navigation system of the carrier 1 performs inertial/satellite hybridization).

At this first instant T1, the decision assistance system 8 is requested as follows to propose a projectile to fire from those available on board the carrier 1.

The first simulator 10 is initialized at the first instant T1 with the solution for navigation associated with the first instant T1, produced by the navigation system of the carrier 1 on the basis of real data originating from sensors, and with the precision relative to this solution for navigation.

Once initialized, the first simulator 10 uses the simulated data which are input to it to implement in an accelerated manner the processing normally performed by the navigation system of the carrier 1. During this step, the first simulator 10 anticipates and produces a succession of solutions for navigation of the carrier 1, which are respectively associated with later instants at the first instant T1, as well as precisions relative to these solutions. One of these solutions for navigation and the precision relative to this solution are associated with the second instant T2 when a projectile is scheduled to separate from the carrier 1.

The second simulator 12 (for simulating the navigation systems of the projectiles) is initialized with the solution for navigation and the precision produced by the first simulator 10 associated with the second instant T2, but produced as anticipated by the first simulator 10 at the first instant T1.

Once initialized, the second simulator 12 uses the simulated data which are input to it to produce as anticipated a succession of solutions for navigation of a reference projectile, which are respectively associated with later instants at the second instant T2, as well as precisions relative to these solutions. One of these solutions for navigation and the precision relative to this solution are associated with the third instant T3 when the reference projectile is scheduled to collide with the target of the mission.

The precision associated with the third instant T3 is then transmitted to the selector 14.

The selector 14 selects the reference projectile as projectile to be fired at the target or not, on the basis of the precision provided by the second simulator 12.

The reference projectile can for example be selected on condition that the precision relative to the solution for navigation of the reference projectile exceeds a predetermined precision threshold.

If the projectile is not selected, it is possible to repeat the above steps for at least one other projectile mounted on the carrier 1, or even all the projectiles mounted on the carrier 1.

The preceding logic is sequential logic which tests the different projectiles in succession by means of a threshold. Alternative instances of logic may be implemented, however.

In particular, it is possible to ensure that the steps implemented by the second simulator 12 are implemented for different projectiles of the mobile carrier. The different precisions associated with the third instant T3 are then transmitted to the selector 14, and the selector 14 selects a projectile to be fired at the target on the basis of the precisions provided by the second simulator 12. The selector 14 selects for example a projectile for which a maximal precision has been produced from the prepared precisions.

The result of selection (or of non-selection) made by the selector 14 can be presented in graphic form on a monitor seen by a pilot of the carrier 1, such that a decision can be made on the projectile to be used for firing at the target.

As a variant, firing of the selected projectile is triggered automatically by the decision assistance system 8.

Once the firing of the selected projectile is initiated, its internal navigation system 6*a* or 6*b* is requested to guide the projectile to the target.

The abovementioned embodiments can form the subject matter variants. In particular, the hybridizations discussed previously are not limited to the particular case of inertial/satellite hybridization. Any one of the hybridizations discussed previously can be implemented more generally between data originating from sensors of different types: optical sensor, radar sensor, etc. It should also be noted that hybridization can comprise calibration by means of an external source.

The invention claimed is:

1. A decision assistance system comprising:

a first simulator for simulating a navigation system of a mobile carrier, the first simulator being configured to apply a first processing repeatedly to a first set of simulated data representative of a configuration of the mobile carrier and of a trajectory of the mobile carrier between a first instant and a second instant so as to produce prior to the second instant a precision of a solution for navigation of the mobile carrier associated with the second instant, a second simulator for simulating a navigation system of a projectile mounted on the mobile carrier, the second simulator being configured to:

a) be initialized with the precision of the solution for navigation of the mobile carrier associated with the second instant, then b) apply a second processing repeatedly to a second set of simulated data representative of a trajectory of the projectile between the second instant and a third instant so as to produce prior to the third instant a precision of a solution for navigation of the projectile associated with the third instant, a selector configured to select or not the projectile as projectile to be fired at a target, as a function of the precision associated with the third instant produced in step b).

2. The decision assistance system according to claim 1, wherein:

the second simulator is further configured to:

c) repeat step b) for at least one further projectile mounted on the mobile carrier, the selector is configured to select a projectile to be fired at the target as a function of the precision associated with the third instant produced in step b) and at least one further precision of a solution for navigation of a further projectile associated with the third instant produced in step c).

3. The decision assistance system according to claim 1, further comprising a navigation system for the mobile carrier, configured to apply the first processing to data acquired by sensors to produce a solution for navigation of the mobile carrier associated with the first instant and a precision of the solution for navigation of the mobile carrier associated with the first instant, wherein the first simulator is configured to be initialized at the first instant with the solution for navigation associated with the first instant and with the precision of the solution for navigation of the mobile carrier associated with the first instant.

4. The decision assistance system according to claim 1, wherein at least one of the first processing and the second processing comprises hybridization being implemented between data originating from sensors of different types.

5. The decision assistance system according to claim 4, wherein the data originating from sensors of different types comprise inertial data and satellite-positioning data.

6. The decision assistance system according to claim 1, wherein the second instant is a predetermined instant when the projectile is to separate from the mobile carrier.

7. The decision assistance system according to claim 1, wherein at least one of the first set of simulated data and the second set of simulated data comprises at least one of the following data:

movement data of the mobile carrier, movement data of the projectile, data characteristic of a receiving device of radiofrequency signals, data characteristic of jamming caused by a jammer on radiofrequency signals, an instant when the projectile is powered up, an instant when the projectile is to be separated from the mobile carrier, an orientation to be adopted by the projectile at the third instant, relative positioning data between the mobile carrier and the projectile between the first instant and the second instant, atmospheric condition data between the first instant and the third instant, topographical data of a zone intended to be traversed by the mobile carrier between the first instant and the third instant.

8. A mobile carrier comprising several projectiles and a system according to claim 1 for decision assistance for firing one of the projectiles at a target.

9. The mobile carrier according to claim 8, wherein the mobile carrier is an aircraft.

10. A decision assistance method comprising:

a) applying by a first simulator a first processing repeatedly to a first set of simulated data representative of a configuration of a mobile carrier and of a trajectory of the carrier between a first instant and a second instant so as to produce prior to the second instant a precision of a solution for navigation of the mobile carrier associated with the second instant, b) initializing a second simulator with the precision of the solution for navigation of the carrier associated with the second instant, c) after initializing the second simulator, applying by the second simulator a second processing repeatedly to a second set of simulated data representative of a trajectory of a projectile mounted on the mobile carrier between the second instant and a third instant so as to produce prior to the third instant a precision of a solution for navigation of the projectile associated with the third instant, e) selecting or not the projectile as projectile to be fired at a target, as a function of the precision associated with the third instant produced in step c).

11. The decision assistance method according to claim 10, comprising a step d) of repeating by the second simulator the second processing for at least one further projectile mounted on the mobile carrier, a projectile to be fired at the target being selected at step e) as a function of the precision associated with the third instant produced in step c) and at least one further precision of a solution for navigation of a further projectile associated with the third instant produced in step d).

12. The decision assistance method according to claim 10, wherein the mobile carrier is an aircraft.

13. The decision assistance method according to claim 10, wherein the projectile is a guided bomb.

14. A non-transitory computer-readable medium comprising code instructions for causing a decision assistance system to perform the decision assistance method as claimed in claim 10.

* * * * *